United States Patent [19]

Irwin

[11] 4,361,924

[45] Dec. 7, 1982

[54] GRIP HANDLE CHUCK

[76] Inventor: Lawrence F. Irwin, 12860 San Fernando Rd., Sylmar, Calif. 91342

[21] Appl. No.: 276,952

[22] Filed: Jun. 24, 1981

[51] Int. Cl.[3] ..... B08B 9/02

[52] U.S. Cl. ..... 15/104.3 SN; 279/1 Q; 279/50

[58] Field of Search ..... 15/104.3 SN; 279/1 Q, 279/50, 57

[56] References Cited

U.S. PATENT DOCUMENTS 3,449,782 6/1969 Hunt ..... 15/104.3 SN

*Primary Examiner*—Edward L. Roberts

*Attorney, Agent, or Firm*—James E. Brunton

[57] ABSTRACT

An improved plumbers' tool of the type employing a helically wound coiled spring which is controllably inserted into waste lines to remove blockages. In operating the tool of the invention a storage drum from which the clean-out spring is payed out is rotated, usually by a small electric motor, and the spring is clamped in a chucking mechanism so as to rotate with the housing. The improvement of the present tool resides in the provision of a unique double fulcrum actuating mechanism which enables the operator, using only one hand, to smoothly and almost effortlessly cause the chucking mechanism to securely engage the coiled spring and prevent slippage thereof even during highly troublesome clean-out operations.

7 Claims, 3 Drawing Figures

GRIP HANDLE CHUCK

BACKGROUND OF THE INVENTION

1. Field of the Invention

The present invention relates generally to plumbers' tools of the type employing a helically wound coiled spring or "snake" which is rotated and inserted into waste lines to remove blockages. More particularly the invention concerns an improved device for pressurally gripping the coiled spring to cause its rotation as the casing containing the spring is rotated by an electric motor.

2. Discussion of the Prior Art

One of the most successful motor driven, lever operated, prior art portable plumbing tools ever developed is the tool described in U.S. Pat. No. 3,449,782. The present invention is an improvement upon this device.

The tool of the present invention is characterized by having a hand held motor at one end of a coiled spring, a storage housing and a manually operated chuck means at the other end through which the spring passes. Several variations of devices of this general type have been suggested. However, most are difficult to operate principally because of a faulty design of the actuating means by which the chuck is moved into and out of gripping engagement with the spring. Unless this actuating means is properly designed the operator cannot satisfactorily regulate the pressure being applied to the spring to controllably cause its rotation as the storage housing is rotated. If too much pressure is applied to the spring the motor will become overloaded and the tool will fail to function properly creating a possibly dangerous situation. If too little pressure is applied to the spring slippage will result and the spring will not rotate.

While the device of the previously mentioned U.S. Pat. No. 3,449,782 was far superior to any devices in competition therewith, the design of the actuating means thereof did not provide for effortless and smooth actuation of the chuck assembly. In a highly novel manner presently to be described, the tool of the present invention overcomes the drawbacks of the prior art predecessor devices by providing a unique double fulcrum arrangement which permits a substantial increase in the controllability of the gripping power of the chucking arrangement of the tool.

SUMMARY OF THE INVENTION

It is an object of the present invention to provide a novel and improved means for gripping an elongated helically coiled spring in a device for housing and rotating the spring.

It is another object of the invention to provide a novel and improved construction which overcomes the disadvantages of prior constructions and which there is provided a chuck operating means which can be easily, smoothly and effortlessly operated with one hand by a squeezing action on a part of the chuck housing and an actuating lever.

Another object is to provide a device of the aforementioned character which can readily be operated by applying only moderate squeezing pressure with either hand.

Still another object is to provide an adjustable lever means embodying a screw, readily turnable with the fingers, which serves to adjust the means to accommodate different sized snakes.

A further object is to modify the actuating lever design shown in U.S. Pat. No. 3,449,782 to provide a unique double fulcrum construction which makes it possible for the operator to supply about 1.6 times greater chuck gripping power over the construction described in the aforesaid patent while applying the same degree of gripping pressure on the actuating lever. In this way the tool can be effectively used in an almost effortless manner by an operator using either his left or right hand.

DESCRIPTION ONE FORM OF THE INVENTION

Figure 1:
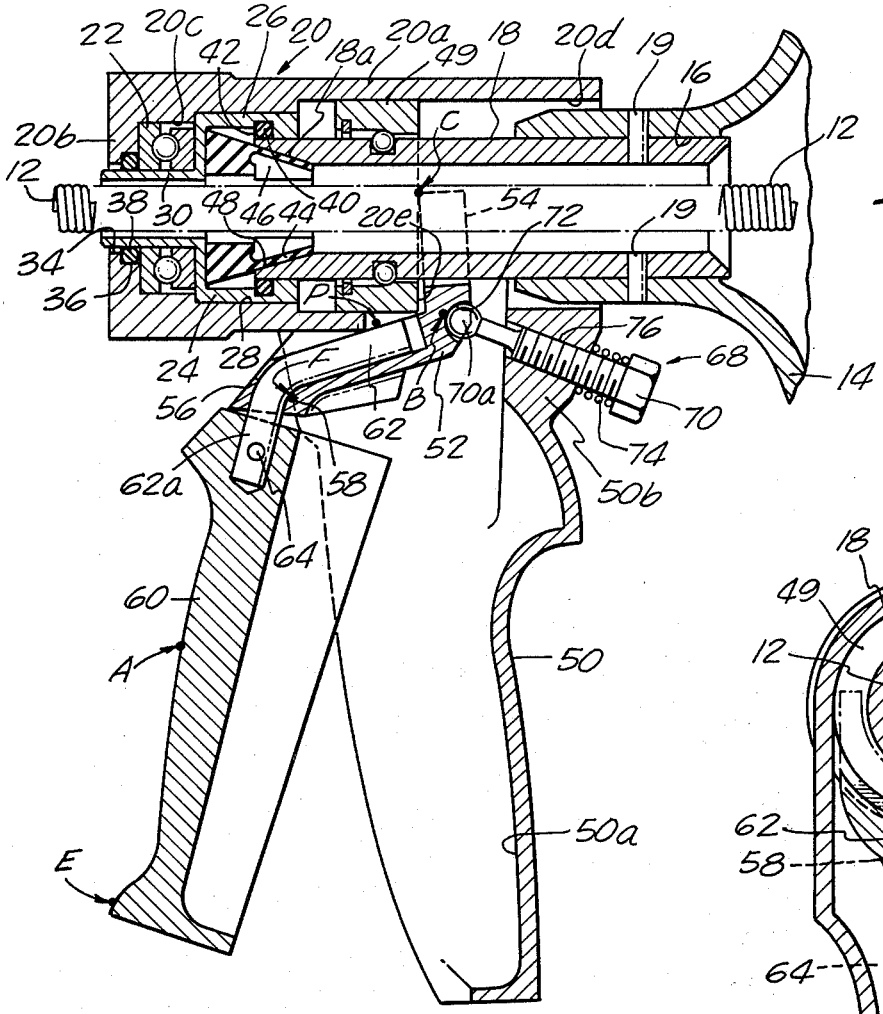
FIG. 1 is a vertical sectional view of the device of the invention showing the device in a normal at rest position.
Figure 3:
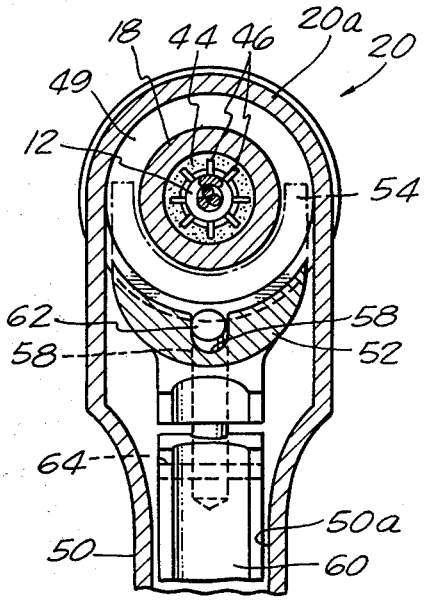
FIG. 3 is a cross-sectional view taken along lines 3—3 of FIG. 2.
Figure 2:
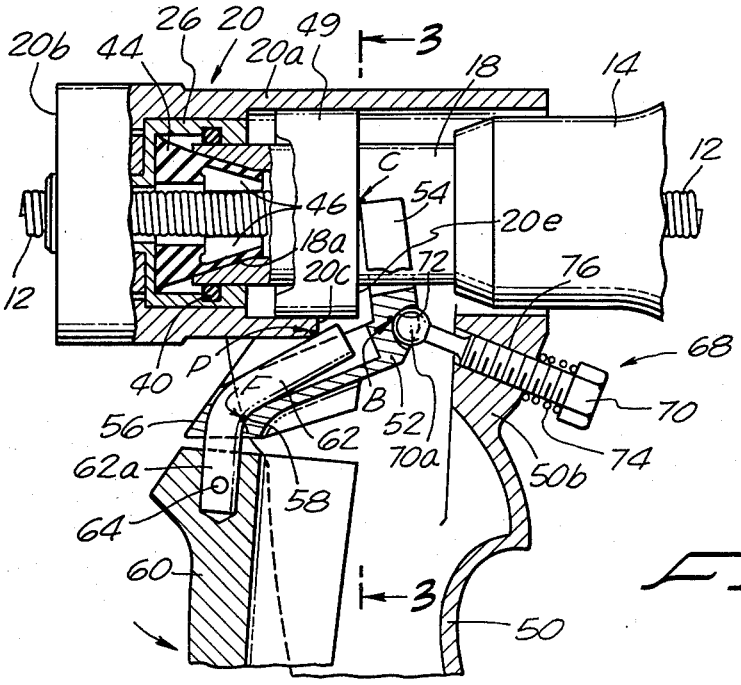
FIG. 2 is a fragmentary sectional view in the same place as FIG. 1 but showing the tool in a feeding mode with the collet chuck contracted about the elongated coil spring.

Referring to the drawings and particularly to FIGS. 1 through 3, the sewer clean-out tool of the present form of the invention comprises an elongated coiled spring 12 extending axially of the tubular shaped body of the device. The coiled spring is payed out from a spring housing 14 (partially shown) which is adapted to contain the spring 12 in a coiled configuration when the tool is not in use. Spring housing 14 is provided with an opening 16 at one side thereof for passage of the coiled spring 12. Projecting forwardly from the spring housing axially of the opening 16 is a tubular spindle 18 which is provided at its forward end with a wedge face **18*a*. Cylindrical or tubular shaped spindle 18 is secured to the housing 14 by means of pins 19. With this construction the spindle is, in effect, a forward extension of the spring housing 14**.

Surrounding spindle 18 is a tubular chuck body 20 which comprises a cylindrical body section **20*a* having an internal flange 20*b* at its outer, or forward, end and inwardly of this, a counter bore 20*c* which accommodates a main thrust bearing 22. Chuck body 20 is also provided with an opening 20*d* at its rearward end into which the spindle and the forward portion of the spring housing is received. A spindle cap 24 is received in the body 20 and has a large cylindrical section 26 which fits in a counter bore 28 and a section 30 of reduced diameter which projects through the bearing 22 and a bore opening 34 formed in the end of body 20. A groove 36 in flange 20*b* accommodates an outer seal ring 38 and a second seal ring 40 is received in a groove 42** in the spindle cap and bears against the outer surface of the spindle.

Within the spindle cap is a chuck collet 44 provided with steel jaw inserts 46. Collet 44 is frustoconical in shape and is partially received within a beveled inner surface 48 of the outer end of spindle 18.

In the embodiment of the tool shown in the drawings, an electric motor (not shown) is mounted onto housing 14 in any suitable manner so that the housing can be rotated relative to the motor casing when the motor is operated. While the coiled spring might rotate with the housing 14 due to friction between the housing and the coils of the spring, since the spring meets considerable resistance as it is fed through a clogged waste pipe or the like, it is necessary to provide means to grip the coiled spring so that it will be locked with the casing and rotate therewith without danger of slipping. The chuck collet 44 comprises a part of said means.

When the tool is at rest the component parts thereof are as shown in FIG. 1. However, upon relative movement of the parts so that the spindle is moved forwardly toward the collet, the latter will be compressed into engagement with the coiled spring in the manner shown in FIG. 2.

To move the parts into driving engagement with the coiled spring, there is provided a uniquely designed actuating means adapted to effortlessly impart relative movement between the spindle and the collet chuck to cause the chuck to contract. The actuating means, which forms an important part of the present invention, operates through a radial thrust bearing 49 which rotatably supports the spindle and in a manner presently to be described, imparts axial movement thereto upon operation of the actuating means.

In the present form of the invention, the actuating means comprises a handle 50 formed as an integral part of the chuck body housing 20 and extends radially thereof in the region of the opening 20*d*. Handle 50 is provided with an elongated channel shaped opening 50*a* which is adapted to partially receive a manually operable lever means adapted to impart forward movement to the thrust bearing 49 and to the spindle 18. In the embodiment of the invention shown in the drawings, the lever means comprises a first, uniquely configured upper portion 52 including a yoke shaped inner end 54 which extends through an opening 20*e* in body 20 for pressural engagement with the thrust bearing 49. The outer or lower end 56 of portion 52 projects forwardly of handle 50 in the manner shown in FIG. 1. Provided proximate end 56 is an aperture 58. As best seen by also referring to FIG. 3, a channel shape opening 58 also extends substantially the length of the first portion 52.

Also forming a part of the lever means of the invention is a first pivot means for pivotally mounting first portion 52 proximate opening 20*d* of body 20. A second, or lower, portion 60 of the lever means is operably associated with first portion 52 and is adapted for limited movement with respect thereto and also with respect to the handle 50.

Interconnecting first and second portions of the lever means is an interconnecting means shown here as comprising a curved rigid member 62 connected at one end 62*a* to a second portion 60 by means of a connecting pin 64. The other, or free end, of the curved rigid member 62 extends upwardly through the aperture 58 formed in portion 52 and toward the tubular chuck body 20*a* with the upper portion of the member being receivable within the channel 58.

Turning to FIG. 2, when the lower portion 60 of the lever means is moved toward the handle 50, as shown by the directional arrow, the upper portion of the rigid member 62 moves out of channel 58 and into pressural engagement with body 20 at a point proximate the edge of opening 20*e* designated in FIG. 2 by the letter "P".

During the movement of the lever means from the position shown in FIG. 1 to that shown in FIG. 2, portion 52 pivots about the previously mentioned first pivot means, generally designated in FIG. 1 by the numeral 68. In the present form of the invention this first pivot means comprises a single screw 70 formed with a ball-like inner end 70*a* which is receivable in a socket 72 formed in portion 52 intermediate its upper and lower ends. A spring 74 about the shank of the screw serves to releasably hold it in adjusted position, the screw being received in a threaded bore 76 in wall 50*b* of handle 50. Screw 70, in conjunction with portions 52, 60 and 62 also serve to retain the chuck body housing 20, bearing 22, spindle cap 24 and chuck collet 44 on the spindle 18.

In using the tool of the invention, the operator holds the motor in one hand and starts and stops it at will. When the motor operates the housing 14 and spindle 18 rotates. In order to positively grip the spring 12 and insure its rotation, the operator grips the handle 50 and lower portion 60 of the lever means moving the latter toward the channeled handle 50. This causes the upper end of rigid member 62 to move upwardly out of the channel formed in portion 52 of the lever means and into pressural engagement with body 20 at the second pivot point "P". Portion 52 of the lever means simultaneously pivots about the first pivot point defined by ball 70*a* thus causing the upper end of portion 52 to pressurally engage thrust bearing 49 moving the forward tapered end of the spindle into engagement with the collet chuck. This in turn causes the chuck to contract and positively engage the coil spring as shown in FIG. 2.

The unique double pivot point feature of the tool of the present invention enables the operator to effortlessly apply substantial pressure to the thrust bearing causing the chuck to grip the spring with ample force to preclude slippage even under the worst of conditions. The unique effect of the double pivot point feature can best be explained by comparing the present improved tool with that described in U.S. Pat. No. 3,449,782. Referring to FIG. 1, the construction of the tool of U.S. Pat. No. 3,449,782 provided a first lever arm that could be described as extending approximately from point A to point B (in practice about 5 inches) and a second lever arm extending from point B to point C (in practice about ½ inch), thus arriving at mechanical advantage of approximately 10 to 1.

In the present tool, a first lever arm extends from point E to point F (approximately 4 inches) and from point F to point P (approximately ½ inch), thus arriving at an advantage of approximately 8 to 1. However, to this advantage is also added an extra lever arm extending from point P to point B (approximately 1 inch) and from point B to point C (approximately ½ inch). The total mechanical advantage, therefore, is about 16 to 1 or 1.6 times greater than that offered by the construction of U.S. Pat. No. 3,449,782.

With this greater mechanical advantage even an operator with a very weak grip can efficiently operate the tool with either his left or right hand.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A sewer cleanout tool, comprising:

(a) an elongated coiled spring;

(b) a spring housing adapted to contain said coiled spring when not in use, said housing having an opening at one side thereof for the passage of said coiled spring; said housing axially of the opening, said spindle having a wedge shaped face;

(d) a tubular chuck body housing surrounding said spindle;

(e) a thrust bearing mounted within said chuck body housing for reciprocal movement therewithin, said thrust bearing being adapted to rotatably support said spindle and to impart axial movement thereto;

(f) a contractable collet chuck carried within said chuck body housing, said chuck having a wedge shaped face adapted to mateably engage said wedge shaped face of said spindle upon relative axial movement between said spindle and said chuck to contract said chuck;

(g) actuating means for imparting relative movement between said spindle and said collet chuck to cause said chuck to contract, said actuating means comprising a handle formed as a part of said chuck body housing and extending radially thereof in the region of said opening, said handle having an elongated channel-shaped forwardly facing opening therein, said actuating means further comprising a manually operable lever means for causing movement of said thrust bearing, said lever means being partially receivable in said channel shaped opening of said handle and including:

(1) a first portion having an inner end engageable with said thrust bearing and an outer end projecting forwardly of said handle said first portion having an aperture formed therein;

(2) first pivot means pivotally mounting said first portion of said lever means proximate said opening in said spring housing;

(3) a second portion operably associated with said first portion and movable with respect thereto and also with respect to said handle;

(4) interconnecting means for interconnecting said first and second portions of said lever means said means comprising a curved rigid member connected at one end to said second portion and extending upwardly through said aperture in said first portion toward said tubular chuck body for pressural engagement therewith proximate the free end of said means to define a second pivot point upon movement of said second portion toward said handle.

2. The sewer clean-out tool as defined in claim 1 in which said chuck body housing has an opening through which said first portion of said lever means extends and in which said first portion of said lever means is supported by said first pivot means comprising a ball-and-socket means disposed in the region of said opening.

3. The sewer clean-out tool as defined in claim 2 in which said ball-and-socket means comprises a screw mounted in said chuck body housing terminating in a ball end received in a socket in said first portion of said lever means.

4. The sewer clean-out tool as defined in claim 2 in which said first portion includes a channel shaped opening adapted to closely receive said free end of said connecting means when the tool is in a normal at rest position.

5. A plumbers' tool of the character which uses an elongated coiled spring and which includes a housing in which the coiled spring can be coiled, said housing having an opening at one side for the passage of the spring, a tubular spindle projecting from the housing axially of the opening, a tubular chuck body housing surrounding said spindle, a main thrust bearing mounted in the outer end of said chuck body beyond the end of said spindle, a collet chuck between said bearing and said spindle, said spindle and collet chuck having interengaging wedge faces whereby to contract said chuck upon relative movement of said bearing and spindle toward each other, a radial thrust bearing on said spindle within said chuck body housing and spaced axially inward of said thrust bearing, said chuck body housing having an opening intermediate its ends in the region of said radial thrust bearing, the improvement comprising actuating means for actuating said chuck including:

(a) a handle formed as a part of said chuck body housing and extending radially thereof in the region of said opening, said handle being channel-shaped in cross-section and open on its edge facing the outer end of said chuck body housing and with the open interior of the handle open to the said opening;

(b) a manually operable lever means operably associated with said handle for causing movement of said thrust bearing, said lever means being partially receivable in the opening provided in said handle and comprising:

(1) a first portion having an inner end engageable with the inner end of said radially thrust bearing and an outer end extending out through said handle and projecting forwardly thereof, said first portion having an aperture therethrough;

(2) first pivot means pivotally mounting said first portion of said lever means proximate said opening;

(3) a second portion operably associated with said first portion and movable with respect thereto and with respect to said handle;

(4) interconnecting means for interconnecting said first and second portions, said interconnecting means comprising a curved member receivable through the aperture formed in said first portion, said curved member being connected at one end to said second portion and being engageable proximate its free end with said housing upon movement of said second portion toward said handle.

6. A plumbers' tool as defined in claim 5 in which said first pivot means comprises a first pivot point for said lever means and said free end of said connecting means comprises a cooperating second pivot point for said lever means.

7. A plumbers' tool as defined in claim 4 in which said first pivot means comprises a screw mounted in said chuck body housing terminating in a ball end received in a socket provided in said first portion of said lever.

* * * * *

UNITED STATES PATENT AND TRADEMARK OFFICE

CERTIFICATE OF CORRECTION

PATENT NO. : 4,361,924

DATED : December 7, 1982

INVENTOR(S) : LAWRENCE F. IRWIN

It is certified that error appears in the above-identified patent and that said Letters Patent is hereby corrected as shown below:

Column 5, line 1, after "spring;" insert --(c) a tubular spindle projecting forwardly from--

Signed and Sealed this

*Fourteenth* Day of *January 1986*

[SEAL]

*Attest:*

*Attesting Officer*

DONALD J. QUIGG

*Commissioner of Patents and Trademarks*